United States Patent [19]

Shibata

[11] Patent Number: 4,636,270

[45] Date of Patent: Jan. 13, 1987

[54] INTERNAL OXIDIZED AG-SN SYSTEM ALLOY CONTACT MATERIALS

[75] Inventor: Akira Shibata, Yokohama, Japan

[73] Assignee: Chugai Denki Kogyo K.K., Tokyo, Japan

[21] Appl. No.: 779,066

[22] Filed: Sep. 23, 1985

[51] Int. Cl.[4] ..... C22C 5/06

[52] U.S. Cl. ..... 148/431; 420/501; 420/506

[58] Field of Search ..... 148/430, 431; 420/501-506

[56] References Cited

U.S. PATENT DOCUMENTS 4,457,787 7/1984 Shibata ..... 148/13.1

4,472,211 9/1984 Shibata ..... 148/20.3

*Primary Examiner*—Christopher W. Brody

*Attorney, Agent, or Firm*—Shlesinger, Fitzsimmons & Shlesinger

[57] ABSTRACT

Electrical contact materials made from an internally oxidized Ag alloy containing 0.5 to 12 weight % of Sn. Internal oxidized structures which have been produced in the alloy at the forwardmost area along a progressive direction of internal oxidation and which are fine and free from the segregation of tin oxides, are employed as contact surfaces. Another surface opposite to said contact surfaces may be brazeable by having it subjected to a reduction or decomposition treatment of metal oxides about said another surface.

3 Claims, No Drawings

INTERNAL OXIDIZED AG-SN SYSTEM ALLOY CONTACT MATERIALS

BACKGROUND OF THE INVENTION

Internal oxidized Ag-Sn system alloys are widely used today as electrical contact materials with excellent physical and electrical properties. They are made by internally oxidizing Ag alloys which have been molten, cast, and rolled or drawn, and are different from those sintered Ag-metal oxides alloys which are made by mixing matric Ag powders with powders of the metal oxides and sintering them. One of their noticeable differences is that the former, viz. internal oxidized Ag-Sn system alloys are far superior to the latter in respect to structural density, while the latter has the more uniform dispersion of metal oxides than the former. The latter may be very readily consumed in too rapid and frequent switching operations.

Therefore, it is a problem to be solved for internal oxidized Ag-Sn system alloys how to make tin oxides dispersed uniformly throughout their internal oxidized Ag matrices. Compared to internal oxidized An-Sn system alloys, internal oxidized Ag-Cd system alloys which had competed with the Ag-Sn system alloys, have a more uniform dispersion of metal oxides. This is chiefly because that the diffusion velocity of Cd in a silver matrix is inherently well balanced with the diffusion velocity of oxygen in the internal oxidation, while they are not so in the case of internal oxidation of Ag-Sn system alloys. In other words, electrical contact materials made of internal oxidized Ag-Cd system alloy and methods for preparing them can hardly be references which are utilizable for the preparation of Ag-Sn system alloys and the internal oxidation thereof.

When Ag-Sn system alloys are subjected to the complete internal oxidation even with the addition of auxiliary solute elements such as In and Bi, it is unavoidable to see segregation of Sn oxides at their outer areas and depletion of said oxides at their inner areas. The segregation of tin oxides which takes sometimes the form of crust about contact surfaces, is chiefly due to an unbalance between diffusion velocities of Sn and oxygen as discussed above. Besides, the diffusion velocity of oxygen itself about the contact surfaces is subject to sharp fluctuations on account of scabs which have been produced about the contact surfaces when alloys were rolled to sheets or drawn to wires. Since oxygen combined to tin in the internal oxidation is double compared to the oxidation of Cd, the aforementioned kind of fluctuations of diffusion velocity of oxygen is serious.

At all events, the segregation of tin oxides about contact surfaces makes them too hard, and often brings about cracks of the surfaces. High electrical contact resistances especially of an initial stage of operations of electrical contacts made from internal oxidized Ag-Sn alloys result from the segregation or excessive concentration of tin oxides about top surfaces. Unduly high raise of temperature of contacts results also from the segregation.

BRIEF SUMMARY OF THE INVENTION

It has been found by the present inventor that, though in the case of internally oxidized structures of an Ag-Sn system alloy, the outer surface or surfaces with which oxygen comes to contact first and from which it penetrates into the alloy are rough, the deeper the structures lie in the alloy, the finer they become. In other words, the internal oxidized structures which have been produced in the alloy remote from said outer surface or surfaces, or at the forwardmost area along a progressive direction of internal oxidation, are fine and free from the segregation of tin oxides. They are, therefore, most suited as contact surfaces.

Such fine internal oxidized Ag-Sn alloy structures at the front or forwardmost area of internal oxidation normally appear, when the alloy is oxidized from both sides, centrally in the alloy with a depletion zone therebetween, and when the alloy is oxidized from a single side, they appear adjacent the bottom or opposite to the surface from which oxygen penetrates into the alloy. Since the depletion zone or a zone where tin oxides are poor lies usually next to the forwardmost area of internal oxidation, said area which is employed in this invention as a contact surface, should be free from the above zones.

Typical constituents of Ag-Sn alloys employable in this invention are those comprising of Ag matrices, 0.5–12 weight % of Sn, and 0.5–15 weight % of In, and those comprising of Ag matrices, 3–12 weight % of Sn, and 0.01–less than 1.5 weight % of Bi. Said constituents may contain one or more metallic elements selected from 0.1–5 weight % of Cd, 0.1–2 weight % of Zn, 0.1–2 weight % of Sb, and 0.01–2 weight % of Pb. In the case of the above-mentioned latter constituents, 0.1–less than 2 weight % of In may be contained.

PREFERRED EMBODIMENTS

EXAMPLE 1

(1) Ag-Sn 8%-In 4%
(2) Ag-Sn 8%-In 4%-Cd 0.5%
(3) Ag-Sn 7%-Bi 0.5%
(4) Ag-Sn 7%-Bi 0.5%-Zn 0.3%

Alloys of the above (1) to (4) were melted in a high frequency melting furnace at about 1,100° to 1,200° C., and poured into molds for obtaining ingots of about 5 Kg each. Each ingot was stripped at its one surface. Then, each ingot was butted opposite its stripped surface to a nickel plate by means of a hydraulic press, and rolled to a plate of about 2.2 mm with the nickel back of about 0.1 mm.

Each plate was subjected to an oxygen atmosphere for 200 hours and at 650° C. so that the plate was completely internal-oxidized. Since the nickel back is unoxidizable, internal oxidation progressed from the stripped surface only. Segregation of tin oxides was observed around the stripped surface. The internal oxidized structures which had been produced in the plate at the forwardmost area along the progressive direction of internal oxidation, viz., in this instance about 2 mm deep from the stripped surface, were extremely fine and completely free from the segregation of metal oxides. A depletion zone or a zone where tin oxides are poor came next to said forwardmost area with a depth of about 1 mm.

Each of the internal oxidized plates were placed in a $H_2$ gas atmosphere and heated at 750° C. for ten minutes, so that metal oxides about the stripped surface were reduced or decomposed whereby the stripped surface could be brazeable to a movable or stationary contact base.

The nickel plate can be replaced by other metals which are not oxidizable, and the reduction or decomposition of metal oxides about the stripped surface may be made by heating in a flux or immersing it into an acid solution.

Then, the plates were horizontally cut at a plane of 0.2 mm from the bottom. And, plates were slitted to obtain square electrical contacts of 5 mm sides and of a thickness of 1.9 mm, having the forwardmost areas of internal oxidation along its progressive direction as contact surfaces, and the reduced or decomposed stripped surfaces as backs.

Instead of slitting the plates after the internal oxidation, they may be cut or pressed out to desired configurations before the internal oxidation.

In order to compare the above electrical contacts made in accordance with this invention, the following contacts were made.

(5) Ag-Sn 8%-In 4%
(6) Ag-Sn 8%-In 4%-Cd 0.5%
(7) Ag-Sn 7%-Bi 0.5%
(8) Ag-Sn 7%-Bi 0.5%-Zn 0.3%

Similarly to the above example, the above alloys (5) to (8) were prepared to ingots. Then, each ingot was butted at its stripped surface to a pure silver plate by means of a hydraulic press, platen of which was heated at about 440° C., and rolled to a plate of about 2 mm thickness, while it was annealed at about 600° C., at every stages of rolling rates of 30% in reduction.

Each plate was internally oxidized in an oxygen atmosphere for 200 hours and at 650° C. Then, internally oxidized plates were pressed by a punch of 6 mm in diameter to obtain electrical contacts of 2 mm in thickness which were backed with a thin silver layer.

The above contact samples of alloys (1) to (4) of this invention and of alloys (5) to (8) of prior known samples were checked of their contact surface hardness, and of their initial contact resistance with the following conditions.

Initial contact resistance:
Contact pressure—400 g
Current—DC 6 V, 1 A

TABLE 1

| Samples | | Hardness (HR "F") |
|---|---|---|
| (1) | "of this invention" | 69–82 |
| (2) | | 67–74 |
| (3) | | 64–76 |
| (4) | | 64–76 |
| (5) | "of prior known samples" | 95–105 |
| (6) | | 93–94 |
| (7) | | 90–100 |
| (8) | | 90–100 |

TABLE 2

| Samples | | Initial contact resistance (mΩ) |
|---|---|---|
| (1) | "of this invention" | 0.6–2.1 |
| (2) | | 0.6–2.1 |
| (3) | | 1.5–1.4 |
| (4) | | 0.5–1.6 |
| (5) | "of prior known samples" | 1.2–2.2 |
| (6) | | 1.2–2.2 |
| (7) | | 0.7–2.1 |
| (8) | | 0.7–2.2 |

Thus, it is known from the above tables that the contact materials made in accordance with this invention have moderate hardness and lower initial contact resistance, compared to corresponding prior-known contact materials.

EXAMPLE 2

An alloy ingot of Ag-Sn 8%-In 4% was drawn to a wire of 5 mm in diameter, from which there were prepared a number of pieces each having a body portion of 5 mm in diameter and 3.3 mm length, which was integrally provided at its both sides with projections of 2.5 mm in diameter and 1 mm in height: Those pieces were completely internally oxidized, and then transversely to their axes cut right in two by a mill with kerf of 0.3 mm so that such rivet-shaped contact materials each having a contact head of 5 mm diameter and 1.5 mm height with a shank of 2.5 mm diameter and 1 mm height, which were characterized by making the forwardmost areas of internal oxidation as contact surfaces, were produced. The pieces may be subjected to $H_2$ gas before or after they were cut to two so that the shank can be brazeable to a contact support metal as described in Example 1.

The rivet-shaped contact materials thus obtained, had excellent physical and electrical characteristics, compared to their correspondent conventional contact materials. It has been observed that their hardness was about 30% less than that of conventional ones, and their initial contact resistance was as much as 50% less.

I claim:

1. Internal oxidized Ag-Sn system alloy electrical contact materials, which are made by the complete internal oxidation of an alloy comprising 0.5–12 weight % of Sn, and 0.5–15 weight % of In or 0.01–less than 1.5 weight % of Bi, to which alloy may be added one or more metallic elements selected from a group consisting of 0.1–5 weight % of Cd, 0.1–2 weight % of Zn, 0.1–2 weight % of Sb, 0.01–2 weight % of Pb, and 0.1–less than 2 weight % of In, and which alloy is characterized by having adjacent a first surface thereof a first area in which metal oxides are segregated, having adjacent the opposite surface thereof a third area comprising the forwardmost area of the internal oxidation along its progressive direction and constituting the contact surface of said alloy, and a second area interposed between said first and third areas and being depleted of said metal oxides, said contact surface having finer internally oxidized structures than said first and second areas.

2. Electrical contact materials as claimed in claim 1, in which said forwardmost area has been exposed to form a contact surface by cutting or shaving the alloy remotely from said first surface from which oxygen was diffused into the alloy for the internal oxidation so that areas which were located adjacently to the forwardmost area were removed off from the alloy.

3. Electrical contact materials as claimed in claim 2, in which the first surface from which oxygen was diffused into the alloy for the internal oxidation, has been subjected to a chemical reaction so that metal oxides thereabout were reduced or decomposed whereby said surface becomes brazeable.

* * * * *